United States Patent [19]

Albanese

[11] Patent Number: 4,764,850

[45] Date of Patent: Aug. 16, 1988

[54] SOLAR-POWERED DISPLAY DEVICE

[76] Inventor: Philip Albanese, 135 Pheasant Run, Louisville, Colo. 80027

[21] Appl. No.: 55,917

[22] Filed: Jun. 1, 1987

[51] Int. Cl.[4] ..... F21V 21/30

[52] U.S. Cl. ..... 362/35; 362/806; 434/386; 40/414; 63/30

[58] Field of Search ..... 434/386; 40/414, 429, 40/473; 362/326, 806, 35; 63/30, 31, 32

[56] References Cited

U.S. PATENT DOCUMENTS 233,364 10/1880 Meyer ..... 63/32

3,325,930 6/1967 Braeutigam ..... 40/473

*Primary Examiner*—Larry I. Schwartz

*Attorney, Agent, or Firm*—John E. Reilly

[57] ABSTRACT

A rotating display unit comprises a motor drive for rotating the drive shaft, the motor drive being powered by a solar cell which is operative to generate a voltage in the presence of sunlight sufficient to energize the motor drive to rotate the drive shaft, and a light refracting, multi-faceted crystal is mounted on the drive shaft for rotation with the shaft to refract the available sunlight into light patterns which are projected onto a surrounding wall surface.

7 Claims, 1 Drawing Sheet

SOLAR-POWERED DISPLAY DEVICE

This invention relates to display devices, and more particularly relates to a novel and improved solar-powered crystal display.

BACKGROUND AND FIELD OF THE INVENTION

Cut glass or multi-faceted crystals are often used to create displays by virtue of their ability to project refracted light onto surrounding wall surfaces. For example, solid crystals of varying configurations or shapes will project light patterns onto another surface in much the same manner as occurs with the use of crystal chandeliers. Crystal displays may be further enhanced by rotating the crystal to generate light patterns of different hues or colors.

In the past, various illuminated displays have been devised in which a rotating display is driven by means of solar cells or light cells. A representative approach is that disclosed in U.S. Pat. No. 3,325,930 to S. Braeutigam wherein a rotating device is powered by light cells, the light cells being employed to energize coreless spools or windings which work in cooperation with magnetic elements to rotate a panel-type advertising display. Similarly, in U.S. Pat. Nos. 4,227,327, 4,517,758 and 4,596,083 to M. E. Thompson an advertising sign or similar device is rotated by means of a solar cell operating through a rechargeable DC motor in the '327 patent. In the '758 patent to Thompson, a solar cell is mounted on a fluorescent light bulb so as to be activated by the light from the bulb itself.

Other patents disclose various types of light display devices for generating a pattern of different colors and, for example, reference is made to U.S. Pat. Nos. 3,119,565 to R. K. Nottingham 3,247,609 to J. D. Hayes et al. In the *Science News* publication, Vol. 97, No. 17 (April, 25, 1970), a multi-colored light is rotated by the heat of an electric light bulb to project flickering pinpoints on surrounding walls of a room while individual facets of the globe present constantly changing colors.

In the present invention, a crystal display is rotated by a solar-powered motor drive so that the same sunlight available to power the motor drive via the solar cell is available for reflection by the crystal onto surrounding wall surfaces in different hues or color patterns.

SUMMARY OF THE INVENTION

Accordingly an object of the present invention is to provide for a novel and improved rotating display device which is economical to manufacture and to operate while creating an aesthetically appealing display.

It is another object of the present invention to provide for a novel and improved glass crystal display which is solar-activated to project available sunlight in different color patterns onto surrounding wall surfaces.

It is a further object of the present invention to provide for a novel and improved manner and means for interchangeable mounting of different shaped crystals on a display device which is solar-activated to rotate the crystals to create different or changing color patterns.

In accordance with the present invention, there has been a devised a crystal glass display device in which a light refracting, multi-faceted crystal is supported on a drive shaft for rotation therewith, and a solar energy cell is operative to generate sufficient voltage in the presence of sunlight to energize a motor drive for the purpose of rotating the drive shaft and causing the crystal to rotate whereby to refract the same available sunlight into different colored light patterns for projection onto the surrounding walls and ceiling of a room. The entire assembly may be incorporated into a single housing or display stand with the drive shaft for the crystal projecting beyond the housing and including a unique form of cup-shaped support for receiving and rotating the crystal.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
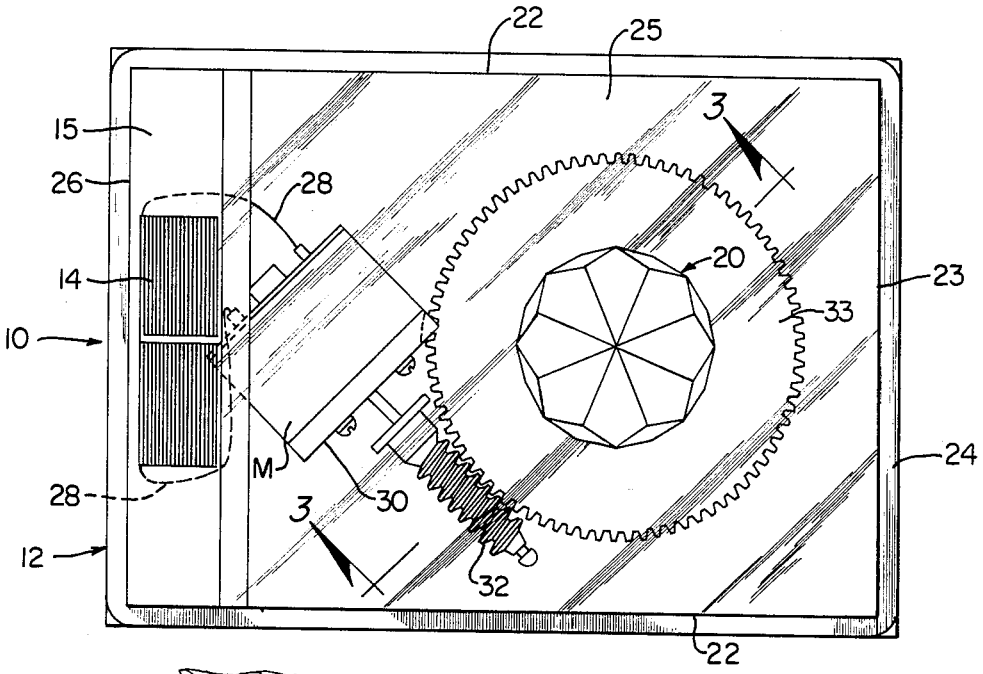
FIG. 1 is a plan view of a preferred form of display device in accordance with the present invention.
Figure 3:
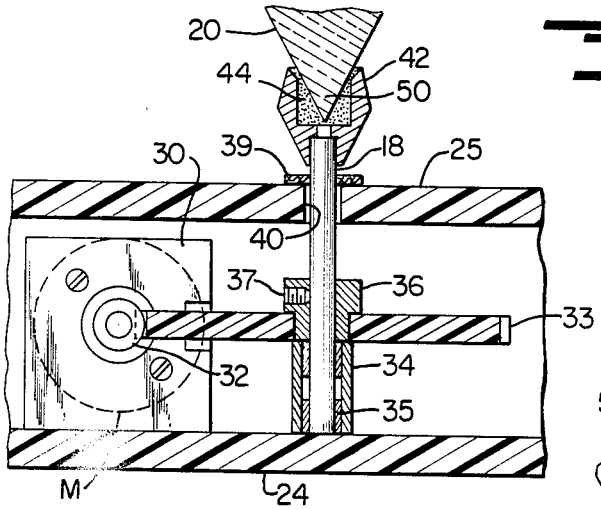
FIG. 3 is a cross-sectional view taken about lines 3—3 of FIG. 1.
Figure 2:
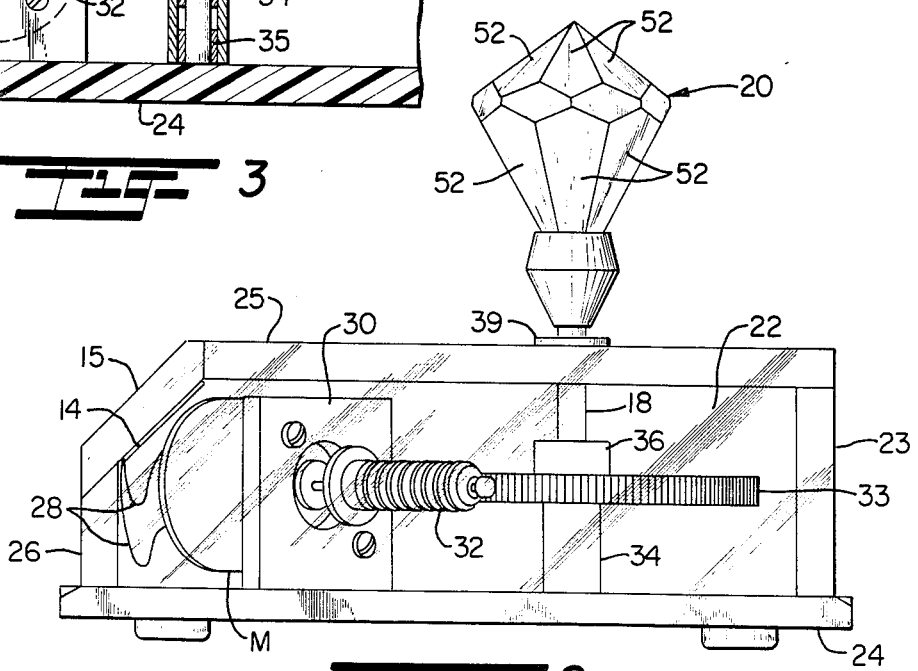
FIG. 2 is a front view in elevation of the preferred form shown in FIG. 1.

Referring in detail to the drawings, there is illustrated in FIGS. 1 to 3 a preferred form of crystal display device 10 which is broadly comprised of a housing 12 with a solar cell unit 14 mounted in an inclined end wall 15 of the housing, and a motor M is positioned within the housing 12. The motor M is operatively connected to a drive shaft 18 which is supported in the housing for upward vertical extension through the housing, and the shaft 18 terminates in an upper terminal end portion to be hereinafter described for releasable support of a multi-faceted crystal unit 20.

In the preferred form, the housing or support means 12 is relatively low profile in configuration having vertical sidewalls 22 and a vertical end wall 23 opposite to the inclined panel 15 and a shorter end wall 26 beneath the panel 15, the side and end walls as described extending upwardly from a common base plate 24. A horizontal upper wall or platform 25 completes the housing enclosure. In this relation, it should be understood at the outset that the housing may assume various forms and configurations, and the particular housing construction as described is given herein more for the purpose of illustration than as a limitation of the invention.

The solar cell panel 14 may be a conventional form of silicon cell of flat, generally rectangular configuration and of a type which may be surfaced with stained glass or other decorative material which will admit sunlight for proper functioning of the cell. For instance, one form of cell is the silicon cell made by Solarex Corp. of Gaithersburg, Maryland and where customarily the single cell is capable of generating one-half volt the voltage and current being proportional to the surface area of the cell and which is electrically connected via leads 28 to drive the constant speed DC motor. One suitable type of motor drive is a low noise series RF510 permanent magnet motor sold by Mabuchi Motor America Corporation of New York, New York. The RF510 is a three pole permanent magnet motor comprised of 315 turns of 0.18 mm. wire per pole and capable of developing 600 rpms in response to the voltage developed by the solar cell as described.

The motor M is supported by a mounting bracket 30, and a worm 32 at the output of the motor intermeshes with a driven gear 33, the latter being in the form of a circular spur gear keyed to drive shaft 18 within the housing 12. The particular gear ratio selected between the worm 32 and driven gear 33 should be sufficient to substantially reduce the speed of the motor drive into the drive shaft 18 while substantially increasing the torque. For example, a speed reduction in excess of 300:1 may be established so that for a motor drive in which the output shaft is rotated at 800 rpms is reduced through the speed reduction gearing to a range of 2 rpms to 3 rpms. The drive shaft 18 is journaled in a bushinq or spindle 34 with an intermediate bearing or sleeve member 35 between the shaft 18 and spindle 34. The qear 33 is keyed to a hub 36 by means of a lock screw 37.

The shaft 18 projects upwardly through a bore 40 in the housing 12 and has an adaptor cup 42 at its upper terminal end and a felt washer 39 beneath the cup 42 and rests on the top surface of the housing 12. The adaptor 42 is recessed to serve as a receptacle for a frictional support member for the crystal display unit 20 to be mounted therein. For example, a suitable material which has been found to be particularly advantageous in supporting the crystal is a putty material as designated at 44 which is molded or shaped to conform to the configuration of the lower end of the crystal and frictionally engages the crystal unit to impart rotation of the drive shaft 18 to the crystal. Utilization of the putty material 44 offers the additional advantage of being interchangeable or re-moldable for different sized cups and shapes of crystal units to be mounted therein.

In the preferred embodiment, the crystal unit 20 is generally diamond-shaped and, for example, may be a leaded glass crystal with a tapered lower end 50 and different-sized facets as generally designated at 52 so as to present different angles for refraction of light striking the crystal into different colors or color patterns. When placed in a room and exposed to sunlight, the crystal unit 20 under rotation will refract the light into a series of spots or patterns of different colors or hues across the walls and ceiling of the room, thus forming an aesthetically appealing display. Most notably, the same sunlight available for refraction by the crystal is capable of energizing the solar cell in order to rotate the crystal without the use of an auxiliary source of power during the daylight hours. Thus, the display unit is highly efficient in that it will rotate only when sunlight is available and can be reflected by the crystal display as described.

The preferred form of crystal display is extremely compact and, for example, the housing may have transparent side and end walls 1.5" high, a square base plate 24 which is approximately 5" in length and width, and an upper transparent horizontal surface 25 is 3.5" by 5". The silicon solar cell is mounted in a panel 1.5" wide by 5" in length and supported on a relatively short end wall 26 at one end.

It is therefore to be understood that various other modifications and changes may be made in the construction and arrangement of elements comprising the preferred embodiment of the present invention without departing from the spirit and scope of the invention as defined by the appended claims.

I claim:

1. A crystal glass display device comprising:

support means including a drive shaft;

motor drive means associated with said support means for rotating said drive shaft;

a light refracting, multi-faceted crystal including means operatively connecting said crystal to said drive shaft for rotating therewith; and solar energy means operative to generate a voltage in the presence of sunlight to energize said motor drive for rotation of said drive shaft thereby causing said crystal to rotate and refract the sunlight which causes said solar energy means to generate the voltage into different colored light patterns, said energy means including a panel associated with said support means in contiguous relation to said crystal, speed reduction means between said motor drive means and said drive shaft, said shaft disposed in upstanding relation to said support housing and having an adaptor at its upper end to support said crystal.

2. A crystal glass display device according to claim 1, said crystal having a downwardly tapered lower end, said adaptor having a complementary cup-shaped recess for insertion of said lower end of said crystal therein.

3. A crystal glass display device according to claim 2, said adaptor containing a putty-like material shaped to conform to the lower end of said crystal.

4. A crystal glass display device according to claim 1, said support means defined by a housing including a top horizontal surface, said solar cell defining one wall of said housing and said drive shaft extending upwardly through said top horizontal surface and having an adaptor at its upper end to releasably support said crystal therein.

5. A crystal glass display device according to claim 4 said solar cell including a panel defining an inclined wall of said housing, a driven gear mounted on said drive shaft and a drive gear, the output of said motor engageable with said driven gear.

6. A crystal glass display device disposed in a room wherein the room has a ceiling and surrounding wall surfaces, said device comprising:

a support housing including a drive shaft;

motor drive means associated with said support means for rotating said drive shaft;

a light refracting, multi-faceted crystal including means operatively connecting said crystal to said drive shaft for rotation therewith; and solar cell means operative to generate a voltage in the presence of sunlight to energize said motor drive for rotation of said drive shaft thereby causing said crystal to rotate and refract available sunlight into different colored light patterns onto the surrounding wall surfaces and ceiling of the room, said solar cell means including a panel associated with said support means in contiguous relation to said crystal, speed reduction means between said motor drive and said drive shaft, said shaft disposed in upstanding relation to said support housing and having an adaptor at its upper end to support said crystal, said crystal having a downwardly tapered lower end, and said adaptor having a complementary cup-shaped recess for insertion of said lower end of said crystal therein.

7. A crystal glass display device according to claim 6, said adaptor containing a putty-like material shaped to conform to the lower end of said crystal, said support housing including a top horizontal surface, and said solar cell means including a panel defining an inclined wall of said housing, a driven gear mounted on said drive shaft and a drive gear, the output of said motor engageable with said driven gear.

* * * * *